US008066087B2

(12) United States Patent
Griffo et al.

(10) Patent No.: US 8,066,087 B2
(45) Date of Patent: Nov. 29, 2011

(54) THERMALLY STABLE ULTRA-HARD MATERIAL COMPACT CONSTRUCTIONS

(75) Inventors: Anthony Griffo, The Woodlands, TX (US); Madapusi K. Keshavan, The Woodlands, TX (US); Youhe Zhang, Tomabll, TX (US); Yuelin Shen, Houston, TX (US); Michael Janssen, Spring, TX (US)

(73) Assignee: Smith International, Inc., Houston, TX (US)

( * ) Notice: Subject to any disclaimer, the term of this patent is extended or adjusted under 35 U.S.C. 154(b) by 895 days.

(21) Appl. No.: 11/745,726

(22) Filed: May 8, 2007

(65) Prior Publication Data

US 2008/0142276 A1 Jun. 19, 2008

Related U.S. Application Data

(60) Provisional application No. 60/799,104, filed on May 9, 2006.

(51) Int. Cl.
*E21B 10/36* (2006.01)
*B24D 3/02* (2006.01)
*C09C 1/68* (2006.01)

(52) U.S. Cl. ..... 175/432; 175/434; 175/435; 51/307; 51/309

(58) Field of Classification Search ..... 51/307, 51/309; 175/432, 434, 435; 407/118
See application file for complete search history.

(56) References Cited

U.S. PATENT DOCUMENTS 3,136,615 A 6/1964 Bovenkerk
3,141,746 A 7/1964 DeLai
3,233,988 A 2/1966 Wentorf, Jr.
3,745,623 A 7/1973 Wentorf, Jr. et al.
4,104,344 A 8/1978 Pope et al.
4,108,614 A 8/1978 Mitchell
4,151,686 A 5/1979 Lee et al.
4,224,380 A 9/1980 Bovenkerk et al.
4,255,165 A 3/1981 Dennis et al.

(Continued)

FOREIGN PATENT DOCUMENTS

EP 0300699 1/1989

(Continued)

OTHER PUBLICATIONS

Third-Party Submission Under 37 C.F.R. 1.99 for U.S. Appl. No. 12/505,316, dated Jan. 21, 2010 (3 pages).

(Continued)

*Primary Examiner* — Anthony Green
*Assistant Examiner* — Pegah Parvini
(74) *Attorney, Agent, or Firm* — Osha Liang LLP

(57) ABSTRACT

Thermally stable ultra-hard compact constructions comprise a polycrystalline diamond body substantially free of a catalyst material, and a substrate that is joined thereto. The substrate can be ceramic, metallic, cermet and combinations thereof, and can be joined to the body by a braze material or other material that forms an attachment bond at high pressure/high temperature conditions. The body and substrate are specially formed having complementary interfacing surface features to facilitate providing an improved degree of attachment therebetween. The complementary surface features can in the form of openings and projections, e.g., one of the body or substrate can comprise one or more openings, and the other of the body or substrate can comprise one or more projections, disposed within or extending from respective interfacing surfaces. The complementary surface features operate to resist unwanted delamination between the body and substrate, thereby extending effective service life of the construction.

10 Claims, 4 Drawing Sheets

U.S. PATENT DOCUMENTS 4,268,276 A 5/1981 Bovenkerk
4,288,248 A 9/1981 Bovenkerk et al.
4,303,442 A 12/1981 Hara et al.
4,311,490 A 1/1982 Bovenkerk et al.
4,373,593 A 2/1983 Phaal et al.
4,387,287 A 6/1983 Marazzi
4,412,980 A 11/1983 Tsuji et al.
4,481,016 A 11/1984 Campbell et al.
4,486,286 A 12/1984 Lewin et al.
4,504,519 A 3/1985 Zelez
4,522,633 A 6/1985 Dyer
4,525,179 A 6/1985 Gigl
4,534,773 A 8/1985 Phaal et al.
4,556,403 A 12/1985 Almond et al.
4,560,014 A 12/1985 Geczy
4,570,726 A 2/1986 Hall
4,572,722 A 2/1986 Dyer
4,604,106 A 8/1986 Hall
4,605,343 A 8/1986 Hibbs, Jr. et al.
4,606,738 A 8/1986 Hayden
4,621,031 A 11/1986 Scruggs
4,629,373 A * 12/1986 Hall ..... 407/118
4,636,253 A 1/1987 Nakai et al.
4,645,977 A 2/1987 Kurokawa et al.
4,662,348 A 5/1987 Hall et al.
4,664,705 A 5/1987 Horton et al.
4,670,025 A 6/1987 Pipkin
4,707,384 A 11/1987 Schachner et al.
4,726,718 A 2/1988 Meskin et al.
4,766,040 A 8/1988 Hillert et al.
4,776,861 A 10/1988 Frushour
4,784,023 A * 11/1988 Dennis ..... 76/108.2
4,792,001 A 12/1988 Zijsling
4,793,828 A 12/1988 Burnand
4,797,241 A 1/1989 Peterson et al.
4,802,539 A 2/1989 Hall et al.
4,807,402 A 2/1989 Rai
4,828,582 A 5/1989 Frushour
4,844,185 A 7/1989 Newton, Jr. et al.
4,861,350 A 8/1989 Phaal et al.
4,871,377 A 10/1989 Frushour
4,882,128 A 11/1989 Hukvari et al.
4,899,922 A 2/1990 Slutz et al.
4,919,220 A 4/1990 Fuller et al.
4,931,068 A 6/1990 Dismukes et al.
4,933,529 A 6/1990 Saville et al.
4,940,180 A 7/1990 Martell
4,943,488 A 7/1990 Sung et al.
4,944,772 A 7/1990 Cho
4,976,324 A 12/1990 Tibbitts
4,987,800 A 1/1991 Gasan et al.
5,011,514 A 4/1991 Cho et al.
5,011,515 A * 4/1991 Frushour ..... 51/307
5,027,912 A 7/1991 Juergens
5,030,276 A 7/1991 Sung et al.
5,032,147 A 7/1991 Frushour
5,068,148 A 11/1991 Nakahara et al.
5,092,687 A 3/1992 Hall
5,116,568 A 5/1992 Sung et al.
5,127,923 A 7/1992 Bunting et al.
5,135,061 A 8/1992 Newton, Jr.
5,176,720 A 1/1993 Martell et al.
5,186,725 A 2/1993 Martell et al.
5,199,832 A 4/1993 Meskin et al.
5,205,684 A 4/1993 Meskin et al.
5,213,248 A 5/1993 Horton et al.
5,238,074 A 8/1993 Tibbitts et al.
5,264,283 A 11/1993 Waldenstrom
5,337,844 A 8/1994 Tibbitts
5,355,969 A 10/1994 Hardy et al.
5,369,034 A 11/1994 Hargett et al.
5,370,195 A 12/1994 Keshavan et al.
5,379,853 A 1/1995 Lockwood
5,439,492 A 8/1995 Anthony et al.
5,464,068 A 11/1995 Najafi-Sani
5,468,268 A 11/1995 Tank et al.
5,494,477 A 2/1996 Flood et al.
5,496,638 A 3/1996 Waldenstrom
5,505,748 A 4/1996 Tank et al.
5,510,193 A 4/1996 Cerutti et al.
5,523,121 A 6/1996 Anthony et al.
5,524,719 A 6/1996 Dennis
5,560,716 A 10/1996 Tank et al.
5,564,511 A * 10/1996 Frushour ..... 175/431
5,605,198 A * 2/1997 Tibbitts et al. ..... 175/432
5,607,024 A 3/1997 Keith et al.
5,620,382 A 4/1997 Cho et al.
5,624,068 A 4/1997 Waldenstrom et al.
5,645,617 A 7/1997 Frushour
5,667,028 A 9/1997 Truax et al.
5,718,948 A 2/1998 Ederyd et al.
5,722,497 A 3/1998 Gum et al.
5,722,499 A 3/1998 Nguyen et al.
5,776,615 A 7/1998 Wong et al.
5,833,021 A 11/1998 Mensa-Wilmot et al.
5,897,942 A 4/1999 Karner et al.
5,954,147 A 9/1999 Overstreet et al.
5,979,578 A 11/1999 Packer
6,009,963 A 1/2000 Chaves et al.
6,041,875 A 3/2000 Rai et al.
6,063,333 A 5/2000 Dennis
6,098,730 A 8/2000 Scott et al.
6,123,612 A 9/2000 Goers
6,126,741 A 10/2000 Jones et al.
6,131,678 A 10/2000 Griffin
6,165,616 A 12/2000 Lemelson
6,193,001 B1 2/2001 Eyre et al.
6,196,341 B1 * 3/2001 Chaves ..... 175/432
6,202,770 B1 3/2001 Jurewicz et al.
6,234,261 B1 5/2001 Evans et al.
6,248,447 B1 6/2001 Griffin et al.
6,269,894 B1 8/2001 Griffin
6,298,930 B1 * 10/2001 Sinor et al. ..... 175/428
6,302,225 B1 10/2001 Yoshida et al.
6,344,149 B1 2/2002 Oles
6,410,085 B1 6/2002 Griffin et al.
6,435,058 B1 8/2002 Matthias et al.
6,443,248 B2 9/2002 Yong et al.
6,447,560 B2 9/2002 Jensen et al.
6,544,308 B2 4/2003 Griffin et al.
6,550,556 B2 4/2003 Middlemiss et al.
6,562,462 B2 5/2003 Griffin et al.
6,585,064 B2 7/2003 Griffin et al.
6,589,640 B2 7/2003 Griffin et al.
6,592,985 B2 7/2003 Griffin et al.
6,601,662 B2 8/2003 Matthias et al.
6,739,214 B2 5/2004 Griffin et al.
6,749,033 B2 6/2004 Griffin et al.
6,797,326 B2 9/2004 Griffin et al.
6,892,836 B1 5/2005 Eyre
7,108,598 B1 9/2006 Galloway
7,377,341 B2 5/2008 Middlemiss et al.
2005/0050801 A1 3/2005 Cho
2005/0129950 A1 6/2005 Griffin et al.
2005/0230156 A1 10/2005 Belnap et al.
2005/0263328 A1 12/2005 Middlemiss
2006/0060390 A1 3/2006 Eyre
2006/0060392 A1 3/2006 Eyre et al.
2006/0157285 A1 * 7/2006 Cannon et al. ..... 175/374
2006/0162969 A1 7/2006 Belnap et al.
2006/0165993 A1 7/2006 Keshavan
2006/0191723 A1 8/2006 Keshavan
2006/0207802 A1 * 9/2006 Zhang et al. ..... 175/374
2006/0266558 A1 11/2006 Middlemiss et al.
2006/0266559 A1 11/2006 Keshavan et al.
2007/0079994 A1 4/2007 Middlemiss
2007/0169419 A1 7/2007 Davis et al.
2007/0181348 A1 8/2007 Lancaster et al.
2007/0187155 A1 8/2007 Middlemiss
2008/0085407 A1 4/2008 Cooley et al.
2008/0185189 A1 8/2008 Griffo et al.
2008/0223621 A1 9/2008 Middlemiss et al.

FOREIGN PATENT DOCUMENTS

EP 0329954 8/1993
EP 0617207 9/1994
EP 0585631 4/1997

| | | | |
|---|---|---|---|
| EP | 0787820 | | 8/1997 |
| EP | 0500253 | | 11/1997 |
| EP | 0595630 | | 1/1998 |
| EP | 0612868 | | 7/1998 |
| EP | 0860515 | | 8/1998 |
| EP | 1116858 | | 7/2001 |
| EP | 1190791 | | 3/2002 |
| EP | 1190791 | A2 | 3/2002 |
| EP | 1958688 | | 8/2008 |
| GB | 1349385 | | 4/1974 |
| GB | 2048927 | | 12/1980 |
| GB | 2268768 | | 1/1994 |
| GB | 2270493 | | 3/1994 |
| GB | 2323398 | | 9/1998 |
| GB | 2351747 | | 1/2001 |
| GB | 2367081 | | 3/2002 |
| GB | 2408735 | | 6/2005 |
| GB | 2413575 | | 11/2005 |
| GB | 2418215 | | 3/2006 |
| GB | 2422623 | | 8/2006 |
| GB | 2427215 | | 12/2006 |
| GB | 2429471 | | 2/2007 |
| GB | 2429727 | | 3/2007 |
| JP | 60187603 | | 10/1984 |
| WO | WO 93/23204 | | 11/1993 |
| WO | WO 96/34131 | | 10/1996 |
| WO | WO 00/28106 | | 5/2000 |
| WO | WO 2004/040095 | | 5/2004 |
| WO | WO 2004/106003 | | 12/2004 |
| WO | WO 2004/106004 | | 12/2004 |
| WO | 2007042920 | | 4/2007 |

OTHER PUBLICATIONS

Search Report for GB 0708915.4 dated Aug 17, 2007, total 4 pages.
Translation of Japanese Unexamined Patent Application No. S59-218500. "Diamond Sintering and Processing Method," Shuji Yatsu and Tetsuo Nakai, inventors; Application published Dec. 10, 1984; Applicant: Sumitomo Electric Industries Co. Ltd. Office Action by USPTO mailed Mar. 11, 2003 for related U.S. Appl. No. 10/065,604.
International Search Report with Written Opinion issued in related International Application No. PCT/US2009/051022 dated Feb. 24, 2010. (11 pages).
International Search Report with Written Opinion issued in related International Application No. PCT/US2009/051047 dated Feb. 24, 2010. (12 pages).
Examination Report under Section 18(3) dated Jun. 30, 2010 issued by the UK Intellectual Property Office in corresponding Application No. GB0708915.4 (1 page).
Examination Report issued in related British Patent Application No. GB0708915.4; Dated Dec. 6, 2010 (5 pages).
US Office Action issued in related U.S. Appl. No. 12/505,316; Dated Dec. 27, 2010 (27 pages).

* cited by examiner

THERMALLY STABLE ULTRA-HARD MATERIAL COMPACT CONSTRUCTIONS

RELATION TO CO-PENDING PATENT APPLICATION

This patent application claims the benefit of priority from U.S. Provisional Patent Application Ser. No. 60/799,104, filed May 9, 2006, which is incorporated herein in its entirety.

FIELD OF THE INVENTION

This invention generally relates to ultra-hard materials and, more specifically, to thermally stable ultra-hard material compact constructions having a thermally stable ultra-hard material body that is attached to a substrate, wherein the interface between the body and the substrate is specially engineered to provide improved retention between the body and substrate, thereby improving the service life of a wear, cutting or tool element formed therefrom.

BACKGROUND OF THE INVENTION

Ultra-hard materials such as polycrystalline diamond (PCD) and PCD elements formed therefrom are well known in the art. Conventional PCD is formed by combining diamond grains with a suitable solvent catalyst material to form a mixture. The mixture is subjected to processing conditions of extremely high pressure/high temperature, where the solvent catalyst material promotes desired intercrystalline diamond-to-diamond bonding between the grains, thereby forming a PCD structure. The resulting PCD structure produces enhanced properties of wear resistance and hardness, making PCD materials extremely useful in aggressive wear and cutting applications where high levels of wear resistance and hardness are desired.

Solvent catalyst materials typically used in forming conventional PCD include metals from Group VIII of the Periodic table, with cobalt (Co) being the most common. Conventional PCD can comprise from 85 to 95% by volume diamond and a remaining amount of the solvent catalyst material. The solvent catalyst material is present in the microstructure of the PCD material within interstices that exist between the bonded together diamond grains.

A problem known to exist with such conventional PCD materials is that they are vulnerable to thermal degradation during use that is caused by differential thermal expansion characteristics between the interstitial solvent catalyst material and the intercrystalline bonded diamond. Such differential thermal expansion is known to occur at temperatures of about 400° C., which can cause ruptures to occur in the diamond-to-diamond bonding that can result in the formation of cracks and chips in the PCD structure.

Another form of thermal degradation known to exist with conventional PCD materials is also related to the presence of the solvent metal catalyst in the interstitial regions and the adherence of the solvent metal catalyst to the diamond crystals. Specifically, the solvent metal catalyst is known to cause an undesired catalyzed phase transformation in diamond (converting it to carbon monoxide, carbon dioxide, or graphite) with increasing temperature, thereby limiting practical use of the PCD material to about 750° C.

Attempts at addressing such unwanted forms of thermal degradation in conventional PCD are known in the art. Generally, these attempts have involved techniques aimed at treating the PCD body to provide an improved degree of thermal stability when compared to the conventional PCD materials discussed above. One known technique involves at least a two-stage process of first forming a conventional sintered PCD body, by combining diamond grains and a solvent catalyst material, such as cobalt, and subjecting the same to high pressure/high temperature process, and then subjecting the resulting PCD body to a suitable process for removing the solvent catalyst material therefrom.

This method produces a PCD body that is substantially free of the solvent catalyst material, hence is promoted as providing a PCD body having improved thermal stability, and is commonly referred to as thermally stable polycrystalline diamond (TSP). A problem, however, known to exist with such TSP is that it is difficult to achieve a good attachment with the substrate by brazing or the like, due largely to the lack of the solvent catalyst material within the body.

The existence of a strong attachment between the substrate and the TSP body is highly desired in a compact construction because it enables the compact to be readily adapted for use in many different wear, tooling, and/or cutting end use devices where it is simply impractical to directly attach the TSP body to the device. The difference in thermal expansion between the TSP body and the substrate, and the poor wettability of the TSP body diamond surface due to the substantial absence of solvent catalyst material, makes it very difficult to bond the TSP body to conventionally used substrates by conventional method, e.g., by brazing process. Accordingly, such TSP bodies must be attached or mounted directly to the end use wear, cutting and/or tooling device for use without the presence of an adjoining substrate.

When the TSP body is configured for use as a cutting element in a drill bit for subterranean drilling, the TSP body itself is mounted to the drill bit by mechanical or interference fit during manufacturing of the drill bit, which is labor intensive, time consuming, and which does not provide a most secure method of attachment.

It is, therefore, desired that an ultra-hard material construction be developed that includes an ultra-hard material body having improved thermal stability when compared to conventional PCD materials, and that accommodates the attachment of a substrate material to the ultra-hard material body so the resulting compact construction can be attached to an application device, such as a surface of a drill bit, by conventional method such as welding or brazing and the like.

SUMMARY OF THE INVENTION

Thermally stable ultra-hard compact constructions, prepared according to principles of this invention, comprise a body formed from a polycrystalline diamond material comprising a plurality of bonded-together diamond crystals. The polycrystalline diamond material is substantially free of a catalyst material. The body can be formed from conventional high pressure/high temperature sintering process using a diamond powder in the presence of a catalyst material. The body is rendered thermally stable by treatment to render the same substantially free of the catalyst material. The compact construction includes a substrate that is joined thereto. The substrate can be selected from the group consisting of ceramics, metals, cermets, and combinations thereof. The substrate can be joined to the body by the use of a braze material or other intermediate material, e.g., capable of forming an attachment bond between the body and substrate at high pressure/high temperature conditions.

A feature of thermally stable ultra-hard compact constructions of this invention is that the body and substrate are specially formed having complementary surface features to facilitate providing the desired improved degree of attachment therebetween. In an example embodiment, the complementary surface features can be provided in the form of openings and projections, e.g., one of the body or substrate can comprise one or more openings, and the other of the body or substrate can comprise one or more projections, disposed within or extending from respective interfacing surfaces. In an example embodiment, the body includes an opening that is disposed at least a partial depth therein, and the substrate includes a projection extending therefrom that is sized to fit within the opening to provide a desired engagement. The number, size and shape of the openings and projections can and will vary depending on the particular end-use application.

Thermally stable ultra-hard compact constructions of this invention comprising such complementary and cooperative surface features operate to resist unwanted delamination between the body and substrate that can occur by side pushing or twisting loads when used in certain wear and/or cutting end use applications, e.g., such as when used as a cutting element in a bit used for drilling subterranean formations, thereby improving the effective service life of such constructions when placed into such applications.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION

As used herein, the term "PCD" is used to refer to polycrystalline diamond formed at high pressure/high temperature (HPHT) conditions, through the use of a solvent metal catalyst, such as those materials included in Group VIII of the Periodic table. PCD still retains the solvent catalyst in interstices between the diamond crystals. "Thermally stable polycrystalline diamond" (TSP) as used herein is understood to refer to bonded diamond that is substantially free of the solvent metal catalyst used to form PCD, or the solvent metal catalyst used to form PCD remains in the diamond body but is otherwise reacted or otherwise rendered ineffective in its ability adversely impact the bonded diamond at elevated temperatures as discussed above.

Thermally stable compact constructions of this invention have a body formed from an ultra-hard material specially engineered to provide an improved degree of thermal stability when compared to conventional PCD materials. Thermally stable compacts of this invention are thermally stable at temperatures greater than about 750° C., and for some demanding applications are thermally stable at temperatures greater than about 1,000° C. The body can comprise one or more different types of ultra-hard materials that can be arranged in one or more different layers or bodies that are joined together. In an example embodiment, the body is formed from TSP.

Thermally stable compact constructions of this invention further include a substrate that is joined to the ultra-hard material body that facilitates attachment of the compact constructions to cutting or wear devices, e.g., drill bits when the compact is configured as a cutter, by conventional means such as by brazing and the like. A feature of compact constructions of this invention is that the body and the substrate each include one or more surface features that cooperate with one another to provide an improved degree of attachment therebetween to provide improved resistance to delamination by side pushing and/or twisting loads that can be imposed thereon when used in a cutting, wear, and/or tooling application.

Generally speaking, thermally stable compact constructions of this invention are formed by first subjecting a desired ultra-hard precursor material to an HPHT processes to form a sintered ultra-hard material body, and then treating the sintered body to render it thermally stable. The ultra-hard precursor material can be selected from the group including diamond, cubic boron nitride, and mixtures thereof. If desired, the ultra-hard precursor material can be formed partially or completely from particles of sintered ultra-hard materials such as PCD, polycrystalline cubic boron nitride, and mixtures thereof.

Figure 1:
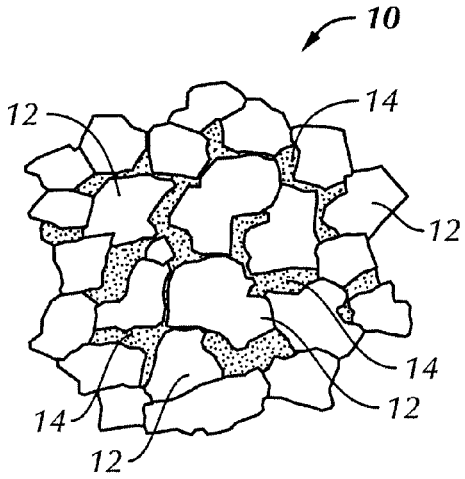
FIG. 1 is a schematic view of a region of an ultra-hard material prepared in accordance with principles of this invention.

FIG. 1 illustrates a region of an ultra-hard material 10 formed during the HPHT process according to this invention. In an example embodiment, the ultra-hard material 10 is PCD having a material microstructure comprising a material phase 12 of intercrystalline bonded diamond made up of bonded together adjacent diamond grains at HPHT conditions. The PCD material microstructure also includes regions 14 disposed interstitially between the bonded together adjacent diamond grains. During the HPHT process, the solvent metal catalyst used to facilitate the bonding together of the diamond grains moves into and is disposed within these interstitial regions 14.

Figure 2:
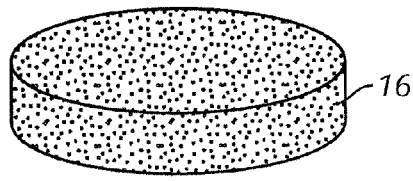
FIG. 2 is a perspective view of an ultra-hard material body of this invention.

FIG. 2 illustrates an example ultra-hard material body 16 formed in accordance with this invention by the HPHT process. The ultra-hard material body 16 is illustrated having a generally disk-shaped configuration with planar upper and lower surfaces, and a cylindrical outside wall surface. It is understood that this is but a preferred configuration and that ultra-hard material bodies of this invention can be configured other than specifically disclosed or illustrated. In an example embodiment, the ultra-hard material body is formed from PCD.

Diamond grains useful for making PCD in the ultra-hard material body include diamond powders having an average particle grain size in the range of from submicrometer in size to 100 micrometers, and more preferably in the range of from about 5 to 80 micrometers. The diamond powder can contain grains having a mono or multi-modal size distribution. In an example embodiment, the diamond powder has an average particle grain size of approximately 20 micrometers. In the event that diamond powders are used having differently sized grains, the diamond grains are mixed together by conventional process, such as by ball or attrittor milling for as much time as necessary to ensure good uniform distribution.

The diamond grain powder is preferably cleaned, to enhance the sinterability of the powder by treatment at high temperature, in a vacuum or reducing atmosphere. The diamond powder mixture is loaded into a desired container for placement within a suitable HPHT consolidation and sintering device.

The device is then activated to subject the container to a desired HPHT condition to consolidate and sinter the diamond powder mixture to form PCD. In an example embodiment, the device is controlled so that the container is subjected to a HPHT process comprising a pressure in the range of from 4 to 7 GPa, and a temperature in the range of from 1.300 to 1500° C., for a period of from 1 to 60 minutes. In a preferred embodiment, the applied pressure is approximately 5.5 GPa, the applied temperature is approximately 1,400° C., and these conditions are maintained for a period of approximately 10 minutes.

During the HPHT process, a catalyst material is used to facilitate diamond-to-diamond bonding between adjacent diamond grains. During such diamond-to-diamond bonding, the catalyst material moves into the interstitial regions within the so-formed PCD body between the bonded together diamond grains. The catalyst material can be that same as that used to form conventional PCD, such as solvent catalyst materials selected from Group VIII of the Periodic table, with cobalt (Co) being the most common.

The catalyst material can be combined with the diamond powder, e.g., in the form of powder, prior to subjecting the diamond powder to the HPHT process. Alternatively, the catalyst material can be provided from a substrate part that is positioned adjacent the diamond powder prior to the HPHT process. In any event, during the HPHT process, the catalyst material melts and infiltrates into the diamond powder to facilitate the desired diamond-to-diamond bonding, thereby forming the sintered product.

The resulting PCD body can comprise 85 to 95% by volume diamond and a remaining amount catalyst material. The solvent catalyst material is present in the microstructure of the PCD material within interstices that exist between the bonded together diamond grains.

After the HPHT process is completed, the container is removed from the device and the resulting PCD body is removed from the container. As noted above, in an example embodiment, the PCD body is formed by HPHT process without having a substrate attached thereto, wherein the catalyst material is combined with the diamond powder. Alternatively, the PCD body can be formed having a substrate attached thereto, providing a source of the catalyst material, during the HPHT process by loading a desired substrate into the container adjacent the diamond powder prior to HPHT processing. In the event that the body is formed using a substrate, the substrate is preferably removed by conventional technique, e.g., by grinding or grit blasting with an airborne abrasive or the like, prior to subsequent treatment to render the body thermally stable.

Once formed, the PCD body is treated to render the entire body thermally stable. This can be done, for example, by removing substantially all of the catalyst material therefrom by suitable process, e.g., by acid leaching, aqua regia bath, electrolytic process, or combinations thereof. Alternatively, rather than removing the catalyst material therefrom, the PCD body can be rendered thermally stable by treating the catalyst material in a manner that renders it unable to adversely impact the diamond bonded grains on the PCD body at elevated temperatures, such as those encountered when put to use in a cutting, wear and/or tooling operation. In an example embodiment, the PCD body is rendered thermally stable by removing substantially all of the catalyst material therefrom by acid leaching technique as disclosed for example in U.S. Pat. No. 4,224,380, which is incorporated herein by reference.

In an example embodiment, where acid leaching is used to remove the solvent metal catalyst material, the PCD body is immersed in the acid leaching agent for a sufficient period of time to remove substantially all of the catalyst material therefrom. In the event that the PCD body is formed having an attached substrate, it is preferred that such substrate be removed prior to the treatment process to facilitate catalyst material removal from what was the substrate interface surface of the PCD body.

In one example embodiment, the PCD body is subjected to acid leaching so that the entire body is rendered thermally stable, i.e., the entire diamond body is substantially free of the catalyst material. FIG. 2 illustrates an embodiment of the ultra-hard material body 16 of this invention, formed from PCD, that has been treated in the manner described above, by immersing the entire body in a desired acid-leaching agent. The particular configuration and dimension of the so-formed thermally stable ultra-hard material body is understood to vary depending on the particular end use application. In an example embodiment, the thermally stable ultra-hard material body may have a thickness in the range of from about 1 to 10 mm. However, thermally stable ultra-hard material bodies of this invention may have a thickness greater than 10 mm depending on the particular application.

It is to be understood that PCD is but one type of ultra-hard material useful for forming the thermally stable ultra-hard material body of this invention, and that other types of ultra-hard materials having the desired combined properties of wear resistance, hardness, and thermal stability can also be used for this purpose. Suitable ultra-hard materials for this purpose include, for example, those materials capable of demonstrating physical stability at temperatures above about 750° C., and for certain applications above about 1,000° C., that are formed from consolidated materials. Example materials include those having a grain hardness of greater than about 4,000 HV. Such materials can include, in addition to diamond and cubic boron nitride, diamond-like carbon, boron suboxide, aluminum manganese boride, and other materials in the boron-nitrogen-carbon phase diagram which have shown hardness values similar to cBN and other ceramic materials.

Although the ultra-hard material body has been described above and illustrated as being formed from a single material, e.g., PCD, that was subsequently rendered thermally stable, it is to be understood that ultra-hard material bodies prepared in accordance with this invention can comprise more than one region, layer, phase, or volume formed from the same or different type of ultra-hard materials. For example, the PCD body can be formed having two or more regions that differ in the size of the diamond grains used to form the same, and/or in the volume amount of the diamond grains used to form the same. Such different regions can each be joined together during the HPHT process. The different regions, layers, volumes, or phases can be provided in the form of different powder volumes, green-state parts, sintered parts, or combinations thereof.

Figure 3:
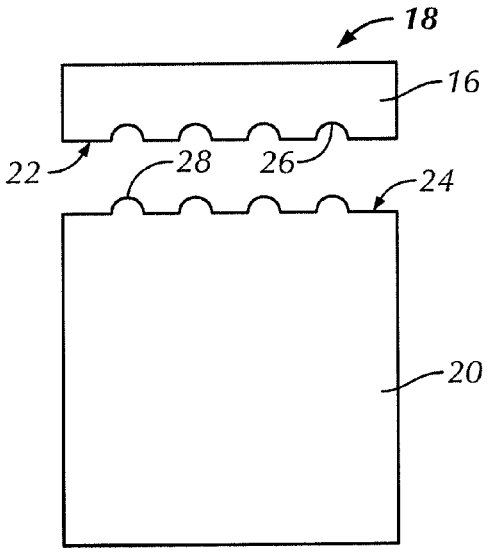
FIG. 3 is a perspective view of a thermally stable ultra-hard material compact construction of this invention in an unassembled state.

As best illustrated in FIG. 3, the thermally stable ultra-hard material body 18 is used to form a compact construction 16 comprising a substrate 20 that is attached to the body. The substrate used to form compact constructions of this invention can be formed from the same general types of materials conventionally used as substrates for conventional PCD materials and include carbides, nitrides, carbonitrides, cermet materials, and mixtures thereof. In an example embodiment, such as that where the compact construction is to be used with a drill bit for subterranean drilling, the substrate can be formed from cemented tungsten carbide (WC—Co).

The body 16 and the substrate 20 each include respective interface surfaces 22 and 24 having surface features that are specially designed to cooperate with one another. In an example embodiment, the interface surfaces 22 and 24 include one or more respective surface features 26 and 28 that are designed to provide a cooperative engagement and/or attachment therebetween. The exact geometry, configuration, number, and placement position of the one or more surface features along the substrate and body interface surfaces is understood to vary depending on the particular end use application for the compact construction. Generally, it is desired that surface features be provided such that they operate to reduce the extent of shear stress and/or residual stress between the body and the substrate than can occur when the compact construction is subjected to side pushing and/or twisting loads when used in a cutting, wear and/or tooling applications. Additionally, the surface features should be configured to provide a sufficient bonding area to facilitate attachment of the body and the substrate to one another. In an example embodiment, it is also desired that the surface features be configured in a manner that is relatively easy to make, thereby not adversely impacting manufacturing efficiency and cost Accordingly, it is to be understood that the surface features of the interface surfaces can be configured other than that specifically described herein and/or illustrated.

The body surface features 26 can be formed during the HPHT process by molding technique, or can be formed after the HPHT process by machining. Similarly, the substrate surface features 28 can be formed either during a sintering process used to form the same, or after such sintering process by machining. In an example embodiment, the body surface features are formed by first removing the carbide substrate after HPHT sintering by machining or alternative postsintering forming process, and the substrate surface features are formed during the sintering process for forming the substrate by using, e.g., special tooling or by plunge electric discharge machining.

Figure 4:
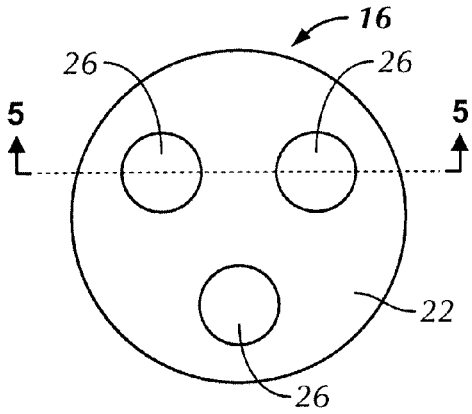
FIG. 4 is a top plan view of an example thermally stable ultra-hard material body used to form a thermally stable ultra-hard material compact construction of this invention.

FIG. 4 illustrates an example embodiment thermally stable ultra-hard material body 16 comprising a number of surface features 26 disposed along a substrate interface surface 22. In this particular embodiment, the interface surface 22 is configured having three surface features 26 that are each provided in the form of circular openings, recesses, or holes having a given diameter and that extend a given depth into the body. The holes are sized to accommodate an equal number of circular elements (not shown) that each project outwardly from a body surface that interfaces with the substrate. In such example embodiment, the holes 26 are sized having a depth that is slightly greater than the length of the protruding elements to ensure that the protruding elements be completely accommodated therein when the body and substrate are joined together.

Figure 5A:
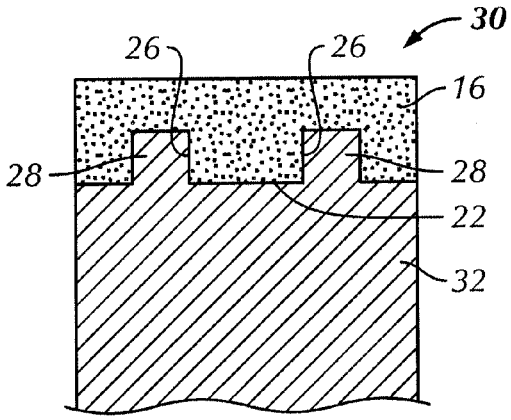
FIGS. 5A and 5B are cross-sectional side views of a thermally stable ultra-hard material bodies used to form a thermally stable ultra-hard material compact construction of this invention.
Figure 5B:
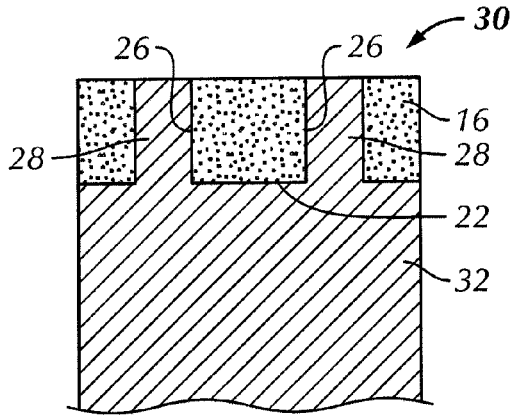

FIGS. 5A and 5B illustrate a thermally stable ultra-hard material compact construction 30 comprising the thermally stable ultra-hard material body 16 as illustrated in FIG. 4, and as further attached with a substrate 32. The body 16 includes the holes or openings 26 extending therein. As illustrated in FIG. 5A, the holes 26 are configured to extend a partial distance or depth into the body from the substrate interface surface 22, and the substrate 32 is constructed having projecting surface features 28 that are configured to fit within respective holes 26.

FIG. 5B illustrates another embodiment thermally stable ultra-hard material compact construction 30 comprising the thermally stable ultra-hard material body as illustrated in FIG. 4. Unlike the embodiment illustrated in FIG. 5A, the ultra-hard material body 16 of this embodiment includes one or more holes or openings 26 that extend completely though the body from the interface surface 22 to an upper surface, i.e., through the entire thickness of the body. The substrate 32 for this embodiment includes one or more projecting surface features 28 that are configured to extend partially or completely through the respective holes 26.

Configured in this manner illustrated in FIG. 5B, the openings not only serve in the manner noted above, to provide a secure attachment with the substrate, but if formed prior to treatment of the PCD to render it thermally stable, the openings through the body thickness also serve to expedite the treatment process. For example, when treating the PCD body by a leaching process, the openings through the body provide a further way for the leaching fluid to access and contact the body, thereby facilitating the process of removing catalyst material therefrom.

Figure 6:
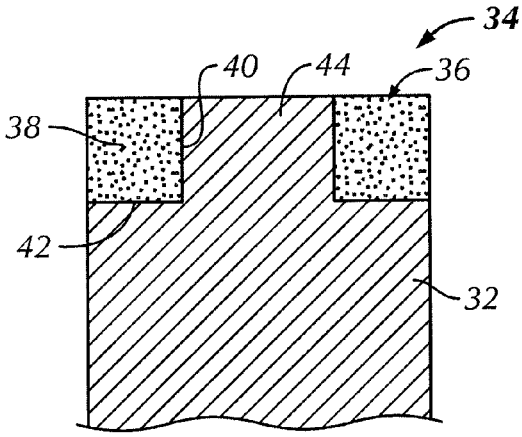
FIG. 6 is a cross-sectional side view of a thermally stable ultra-hard material compact construction of this invention.

FIG. 6 illustrates another embodiment of the thermally stable ultra-hard material compact construction 34 comprising an ultra-hard material body 36 that is attached to a substrate 38. In this particular embodiment, the body 36 is provided in the form of an annular member 38 comprising a central opening 40 that extends axially therethrough from a substrate interface surface 42 to an upper surface. The substrate includes a surface feature 44 that projects outwardly therefrom, and that is configured to fit within the body opening.

While the openings and projecting elements have been described and/or illustrated as having a circular geometry, it is to be understood that such arrangement of openings and projecting elements may be configured having different cooperating geometries that are not circular, e.g., square, triangular, rectangular, or the like. Additionally, while the surface features of the body and substrate interface surfaces have been disclosed as being openings in the body and projecting elements in the substrate, it is to be understood that compact constructions of this invention may be equally configured such that the body includes the projecting elements and the substrate include the accommodating openings, and/or such that the interface surfaces of the body and the substrate each have an arrangement of one or more openings and projecting elements.

Additionally, while the surface features of the body and substrate have been described and illustrated as being positioned along respective body and substrate interfacing surfaces having certain geometry, it is to be understood that the interface surfaces of the body and/or substrate can be configured differently that described and/or illustrated. For example, instead of the body or substrate having an interface surface that extends diametrically along an entire portion of the body or substrate, the interface surface may only occupy a portion or section of the body or substrate. Further, the interface surface of the body and/or the substrate can be configured to extend in a direction that is other than generally perpendicular to a radial axis of the body and/or substrate.

Figure 7:
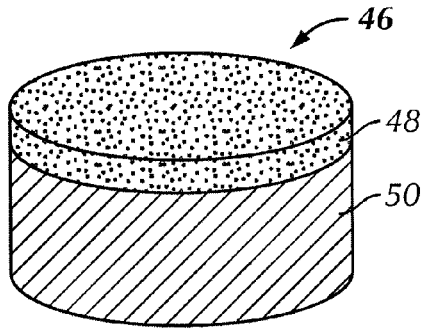
FIG. 7 is a perspective side view of a thermally stable ultra-hard material compact construction of this invention in an assembled state.
Figure 8:
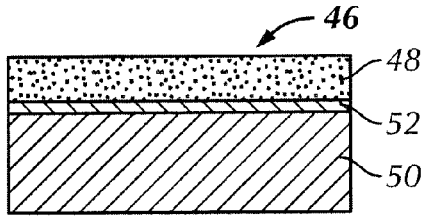
FIG. 8 is a cross-sectional side view of the thermally stable ultra-hard material compact construction of FIG. 7.

FIGS. 7 and 8 illustrate a thermally stable ultra-hard material compact construction 46 of this invention comprising the thermally stable ultra-hard material body 48 attached to the substrate 50. While the body 48 is shown as comprising a uniform material construction, it is to be understood that the body can have a composite construction as described above comprising a number of individual layers, regions, volumes, or phases of materials joined together during the HPHT process. In such an embodiment, the composite ultra-hard material body can be formed from individual layers, regions, or phases that may or may not already be sintered before assembly to form the final composite body. Accordingly, it is to be understood that for such composite body embodiment, the body can be formed during one or a number of different HPHT processes, e.g., to form the individual body regions and/or to form the overall body construction. Again, the actual construction of the body can and will vary depending on the end use application.

As best shown in FIG. 8, an intermediate material 52 is interposed between the body and the substrate for the purpose of assisting with the surface features to join the body and substrate together. In an example embodiment, the intermediate material 52 is a braze material that is applied using a brazing technique useful for joining a carbide-containing substrate to a TSP body. In an example embodiment, the braze technique that is used may include microwave heating, combustion synthesis brazing, combinations of the two, and/or other techniques found useful for effectively attaching the substrate to the TSP body. The brazing technique can use conventional braze materials and/or may use special materials.

Compact constructions of this invention are made by joining the thermally stable ultra-hard material body together with the substrate so that the interfacing surface features cooperate with one another, and then brazing the body and the substrate together by one or more of the brazing techniques described above. Alternatively, the intermediate material can be one that can facilitate attachment of the TSP body to the substrate, after the two have been combined within one another so that the surface features of each are engaged, by a HPHT process rather than by brazing.

Together, the presence of the cooperating surface features along the body and substrate interface surfaces act with the intermediate material to form a strong connection between the body and the substrate, thereby operating to reduce or eliminate the possibility of the two becoming delaminated due to shear stress and/or residual stress when placed in a cutting, wear, and/or tooling application.

The above-described thermally stable ultra-hard material compact constructions formed according to this invention will be better understood with reference to the following example:

Example

Thermally Stable Ultra-Hard Material Compact

Synthetic diamond powders having an average grain size of approximately 2-50 micrometers are mixed together for a period of approximately 2-6 hours by ball milling. The resulting mixture includes approximately six percent by volume cobalt solvent metal catalyst based on the total volume of the mixture, and is cleaned by heating to a temperature in excess of 850° C. under vacuum. The mixture is loaded into a refractory metal container and the container is surrounded by pressed salt (NaCl), and this arrangement is placed within a graphite heating element. This graphite heating element containing the pressed salt and the diamond powder encapsulated in the refractory container is then loaded in a vessel made of a high-pressure/high-temperature self-sealing powdered ceramic material formed by cold pressing into a suitable shape. The self-sealing powdered ceramic vessel is placed in a hydraulic press having one or more rams that press anvils into a central cavity. The press is operated to impose a pressure and temperature condition of approximately 5,500 MPa and approximately 1,450° C. on the vessel for a period of approximately 20 minutes.

During this HPHT processing, the cobalt solvent metal catalyst infiltrates through the diamond powder and catalyzes diamond-to-diamond bonding to form PCD having a material microstructure as discussed above and illustrated in FIG. 1. The container is removed from the device, and the resulting PCD diamond body is removed from the container and subjected to acid leaching. The PCD diamond body has a thickness of approximately 1,500 to 3,500 micrometers. The entire PCD body is immersed in an acid leaching agent comprising hydrofluoric acid and nitric acid for a period time sufficient to render the diamond body substantially free of the solvent metal catalyst.

The body is configured having a number of openings disposed along an interface surface as illustrated in FIG. 4, and a WC—Co substrate having a thickness of approximately 12 millimeters is configured having an equal number of equally positioned projections extending from an interface surface. The body and substrate are brought together with one another so that the surface features of each are aligned and cooperate with one another, and the body and substrate are joined together by a brazing technique.

This compact is finished machined to the desired size using techniques known in the art, such as by grinding and lapping. It is then tested in a dry high-speed lathe turning operation where the compact is used to cut a granite log without coolant. The thermally stable ultra-hard material compact of this invention displays an effective service life that is significantly greater than that of a conventional PCD compact.

A feature of thermally stable ultra-hard material compact constructions of this invention is that they include an ultra-hard material body this is thermally stable and that is attached to a substrate. A further feature is that the body and substrate are each configured having cooperating interfacing surface features that operate to resist unwanted delamination that can occur between the body and substrate caused by side pushing and/or twisting loads imposed during operation in a wear, cutting, and/or tooling application.

Further, because thermally stable ultra-hard material compact constructions of this invention include a substrate, they can be easily attached by conventional attachment techniques such as brazing or the like to a wide variety of different types of well known cutting and wear devices such as drill bits and the like.

Thermally stable ultra-hard material compact constructions of this invention can be used in a number of different applications, such as tools for mining, cutting, machining and construction applications, where the combined properties of thermal stability, wear and abrasion resistance are highly desired. Thermally stable ultra-hard material compact constructions of this invention are particularly well suited for forming working, wear and/or cutting components in machine tools and drill and mining bits such as roller cone rock bits, percussion or hammer bits, diamond bits, and shear cutters.

Figure 9:
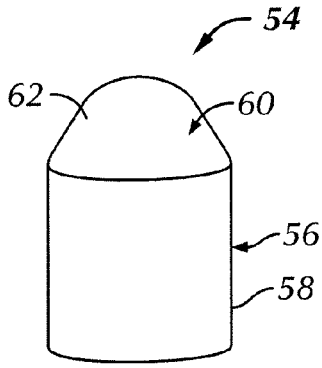
FIG. 9 is a perspective side view of an insert, for use in a roller cone or a hammer drill bit, comprising the thermally stable ultra-hard material compact construction of this invention.

FIG. 9 illustrates an embodiment of a thermally stable ultra-hard material compact construction of this invention provided in the form of a cutting element embodied as an insert 54 used in a wear or cutting application in a roller cone drill bit or percussion or hammer drill bit. For example, such inserts 54 can be formed from blanks comprising a substrate portion 56 formed from one or more of the substrate materials 58 disclosed above, and an ultra-hard material body 60 having a working surface 62 formed from the thermally stable region of the ultra-hard material body. The blanks are pressed or machined to the desired shape of a roller cone rock bit insert.

Figure 10:
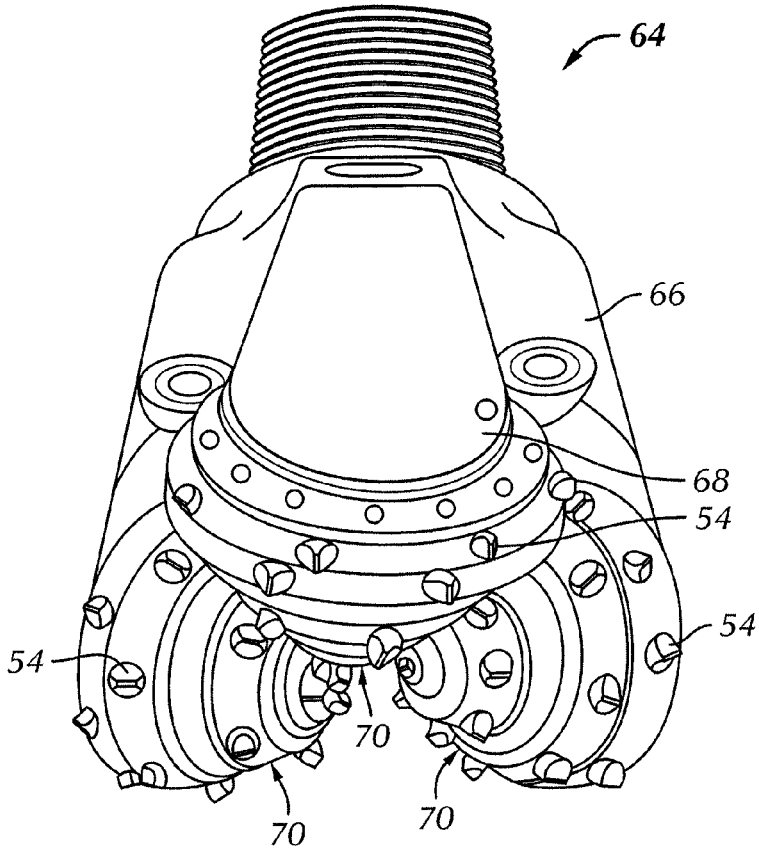
FIG. 10 is a perspective side view of a roller cone drill bit comprising a number of the inserts of FIG. 9.

FIG. 10 illustrates a rotary or roller cone drill bit in the form of a rock bit 64 comprising a number of the wear or cutting inserts 34 disclosed above and illustrated in FIG. 9. The rock bit 64 comprises a body 66 having three legs 68, and a roller cutter cone 70 mounted on a lower end of each leg. The inserts 54 can be fabricated according to the method described above. The inserts 54 are provided in the surfaces of each cutter cone 70 for bearing on a rock formation being drilled.

Figure 11:
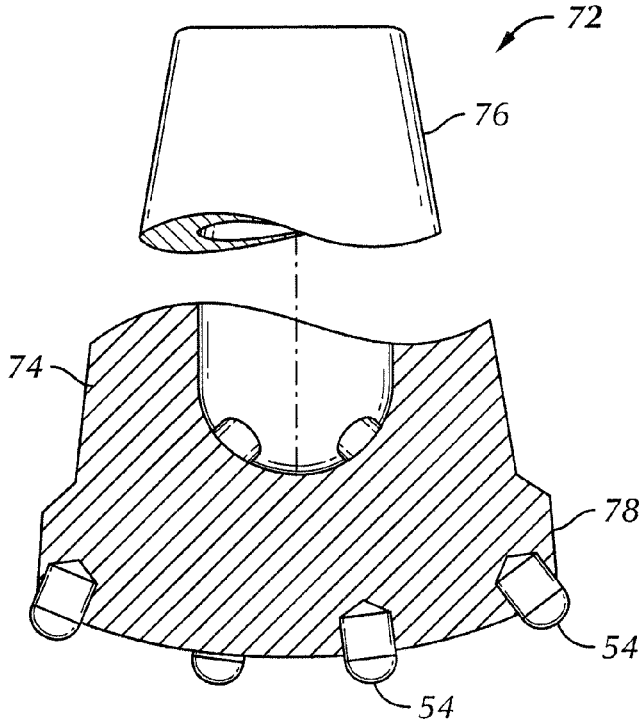
FIG. 11 is a perspective side view of a percussion or hammer bit comprising a number of inserts of FIG. 9.

FIG. 11 illustrates the inserts 54 described above as used with a percussion or hammer bit 72. The hammer bit comprises a hollow steel body 74 having a threaded pin 76 on an end of the body for assembling the bit onto a drill string (not shown) for drilling oil wells and the like. A plurality of the inserts 54 (illustrated in FIG. 9) is provided in the surface of a head 78 of the body 74 for bearing on the subterranean formation being drilled.

Figure 12:
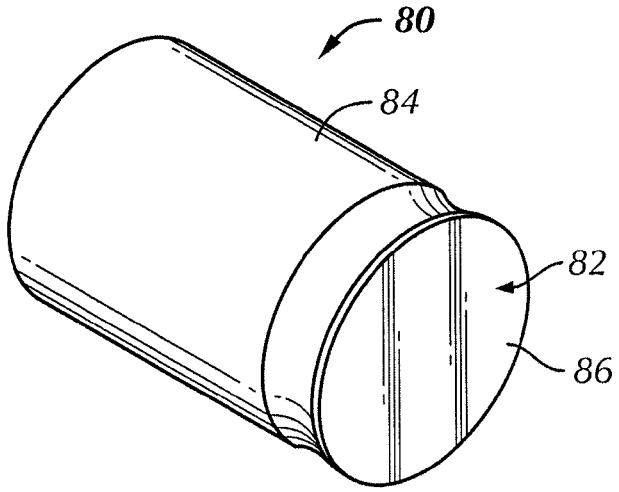
FIG. 12 is a schematic perspective side view of a diamond shear cutter comprising the thermally stable ultra-hard material compact construction of this invention.

FIG. 12 illustrates a thermally stable ultra-hard material compact construction of this invention as embodied in the form of a shear cutter 80 used, for example, with a drag bit for drilling subterranean formations. The shear cutter 80 comprises a thermally stable ultra-hard material body 82 that is sintered or otherwise attached/joined to a cutter substrate 84. The thermally stable ultra-hard material body includes a working or cutting surface 86 that is formed from the thermally stable region of the ultra-hard material body.

Figure 13:
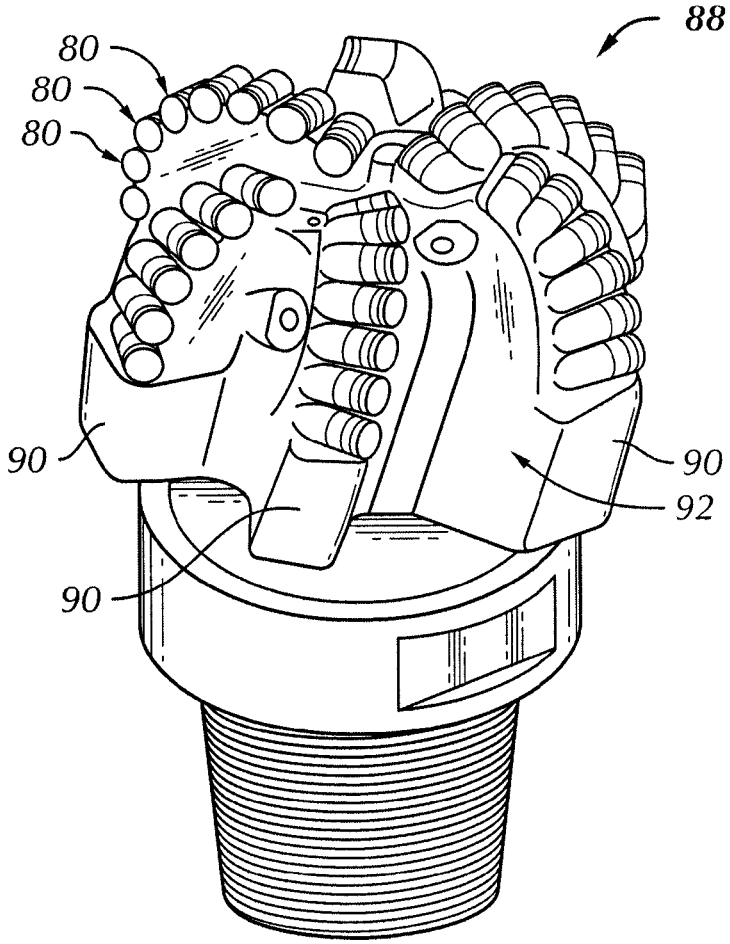
FIG. 13 is a perspective side view of a drag bit comprising a number of the shear cutters of FIG. 12.

FIG. 13 illustrates a drag bit 88 comprising a plurality of the shear cutters 80 described above and illustrated in FIG. 12. The shear cutters are each attached to blades 90 that extend or project outwardly from a head 92 of the drag bit for cutting against the subterranean formation being drilled.

Other modifications and variations of thermally stable ultra-hard material compact constructions will be apparent to those skilled in the art. It is, therefore, to be understood that within the scope of the appended claims, this invention may be practiced otherwise than as specifically described.

What is claimed is:

1. A method for making a thermally stable ultra-hard material compact construction comprising a body and a substrate, the method comprising the steps of:

forming a thermally stable polycrystalline diamond body by removing substantially all of a catalyst material therefrom from a polycrystalline diamond body, wherein the entire polycrystalline diamond body is immersed in a leaching agent to remove substantially all of the catalyst material;

aligning complementary surface features positioned along interfacing surfaces of the thermally stable polycrystalline diamond body and substrate with one another so that they engage one another; and joining the thermally stable polycrystalline diamond body to the substrate.

2. The method of claim 1, further comprising:

forming the polycrystalline diamond body, wherein the step of forming the polycrystalline diamond body comprises:

loading a plurality of diamond grains adjacent to a first substrate, wherein the first substrate comprises the catalyst material;

subjecting the plurality of diamond grains and the first substrate to high pressure, high temperature processing, such that the polycrystalline diamond body is formed having the first substrate attached thereto; and removing the first substrate from the polycrystalline diamond body.

3. The method as recited in claim 1 wherein the step of joining is achieved at high pressure/high temperature conditions, and an intermediate material is selected to form an attachment bond between the substrate and body at such conditions.

4. The method as recited in claim 1 further comprising the step of forming the complementary surface features in the body and the substrate, wherein the complementary surface features comprise at least one opening and at least one projection.

5. The method as recited in claim 4 wherein the at least one opening is disposed at least partially through the body and is formed before the catalyst material is removed therefrom.

6. The method as recited in claim 5 wherein the at least one opening extends completely through the body from its interfacing surface to an opposite body surface, such that the at least one opening extends through the entire thickness of the body.

7. The method as recited in claim 6 wherein at least one projection is at least partially disposed within the opening.

8. The method as recited in claim 7 wherein during the step of joining, an intermediate material is used to attach the substrate to the body.

9. The method as recite in claim 8 wherein the intermediate material is a braze material.

10. The method as recited in claim 8 wherein the step of joining is achieved at high pressure/high temperature conditions, and the intermediate material is selected to form an attachment bond between the substrate and body at such conditions.

* * * * *